US009302324B1

(12) United States Patent
Martinez-Inesta et al.

(10) Patent No.: US 9,302,324 B1
(45) Date of Patent: Apr. 5, 2016

(54) METHOD FOR SYNTHESIZING METAL NANOWIRES IN ANODIC ALUMINA MEMBRANES USING SOLID STATE REDUCTION

(71) Applicants: Maria M Martinez-Inesta, Mayaguezq, PR (US); Jennie Feliciano, Aguada, PR (US); Leonel Quiñones-Fontalvo, Mayaguez, PR (US)

(72) Inventors: Maria M Martinez-Inesta, Mayaguezq, PR (US); Jennie Feliciano, Aguada, PR (US); Leonel Quiñones-Fontalvo, Mayaguez, PR (US)

(73) Assignee: University of Puerto Rico, San Juan, PR (US)

( * ) Notice: Subject to any disclaimer, the term of this patent is extended or adjusted under 35 U.S.C. 154(b) by 121 days.

(21) Appl. No.: 14/170,444

(22) Filed: Jan. 31, 2014

Related U.S. Application Data

(60) Provisional application No. 61/758,891, filed on Jan. 31, 2013.

(51) Int. Cl.

| | |
|---|---|
| ***B22F 9/24*** | (2006.01) |
| ***B82Y 40/00*** | (2011.01) |
| ***C22B 15/00*** | (2006.01) |
| ***C22B 3/00*** | (2006.01) |

(52) U.S. Cl.
CPC . *B22F 9/24* (2013.01); *C22B 11/04* (2013.01); *C22B 15/00* (2013.01); *B22F 2009/245* (2013.01)

(58) Field of Classification Search
None
See application file for complete search history.

(56) References Cited

U.S. PATENT DOCUMENTS

| | | | | |
|---|---|---|---|---|
| 7,575,735 | B2 * | 8/2009 | Wong | B82Y 30/00 423/518 |
| 2013/0084210 | A1 * | 4/2013 | Wong | B22F 9/24 420/591 |
| 2014/0065437 | A1 * | 3/2014 | Wong | B82Y 30/00 428/615 |

OTHER PUBLICATIONS

Zhou, H. et al., "Enhanced Electrocatalytic Performance of One-Dimensional Metal Nanowires and Arrays Generated via an Ambient, Surfactantless Synthesis", J. Phys. Chem. C, vol. 113, pp. 5460-5466, Published on Web Mar. 17, 2009.*

* cited by examiner

*Primary Examiner* — George Wyszomierski
(74) *Attorney, Agent, or Firm* — Hoglund & Pamias, PSC; Roberto J. Rios

(57) ABSTRACT

The invention proposes a novel method for the fabrication of regular arrays of MNWs using solid-state reduction (SSR). Using this method copper (Cu), silver (Ag), and palladium (Pd) nanowire (NWs) arrays were synthesized using anodic alumina membranes (AAMs) as templates. Depending on the metal loading used the NWs reached different diameters.

10 Claims, 2 Drawing Sheets

METHOD FOR SYNTHESIZING METAL NANOWIRES IN ANODIC ALUMINA MEMBRANES USING SOLID STATE REDUCTION

GOVERNMENT INTEREST

The claimed invention was made with U.S. Government support under grant number NNX08BA48A awarded by the National Aeronautics and Space Administration (NASA). The government has certain rights in this invention.

BACKGROUND OF THE INVENTION

Nanowires are studied due to their potential use in applications such as nanoscale electronic, magnetic, optical, and mechanical devices. These types of materials have been employed for the fabrication of field emission devices, microwave devices, high-density magnetic recording devices, nanoelectrodes, and sensors, among others.

In particular, Cu NWs have potential applications in the microelectronics industry for interconnection in electronic circuits. They are also being explored as emitters in field emission devices and as transparent conducting electrodes for solar cell and flexible electronic devices. Ag NWs, on the other hand, are attracting attention because of their peculiar electrical, thermal, and optical properties. Transparent conductive films of Ag nanowires have proven to have the potential to replace the commonly used tin-doped indium oxide ITO films in applications such as solar cells, displays, touch panels, organic light-emitting diodes (OLED), etc. Other studies on Pd NWs show that they play a key role in fuel cell research and are being extensively studied for catalytic combustion, methanol oxidation, hydrogen sensors, and hydrogen storage [16,9].

Many chemical methods have been developed for the preparation of NWs such as lithography [17], chemical vapor deposition, and electrodeposition. Among these methods, the template synthesis is considered a useful technique that can be used for the preparation of different types of nanostructures in which diverse porous materials are commonly used as casts. Commercial anodic alumina membranes (AAM) are commonly used as templates due to their stability at high temperatures and in organic solvents. Their morphology consists of an ordered array of cylindrical pores perpendicular to the surface, which helps in the fabrication of oriented nanostructures with a specific shape and diameter.

The quest for novel synthesis methods to produce nanoobjects that provide control over specific structural, geometrical, and spatial features is one of the main topics of interest in nanotechnology. Therefore, this invention provides the synthesis of Cu, Ag and Pd NWs through the novel and low cost method of solid-state reduction (SSR) using AAM as a template. Pd NWs were also obtained by electrodeposition and the results are compared.

SUMMARY OF THE INVENTION

The invention proposes a novel method for the fabrication of regular arrays of MNWs using solid-state reduction (SSR). Using this method copper (Cu), silver (Ag), and palladium (Pd) nanowire (NWs) arrays were synthesized using anodic alumina membranes (AAMs) as templates, wherein $NaBH_4$ is also used during the method for reducing the metals. Depending on the metal loading used the NWs reached different diameters.

BRIEF DESCRIPTION OF THE DRAWINGS

Further features and advantages of the invention will become apparent from the following detailed description taken in conjunction with the accompanying figures showing illustrative embodiments of the invention, in which.

Throughout the figures, the same reference numbers and characters, unless otherwise stated, are used to denote like elements, components, portions or features of the illustrated embodiments. The subject invention will be described in detail in conjunction with the accompanying figures, in view of the illustrative embodiments.

DETAILED DESCRIPTION OF THE INVENTION

Solid-State Reduction Synthesis

A metal loading of 5 wt. % in each case was deposited over the surface of an AAM using incipient wetness impregnation. A mass of 0.0135 g of $AgNO_3$ (ACS 99.9% metal basis Alfa Aesar), 0.0088 g of $Cu(NO_3)_2.2.5H_2O$ (Sigma Aldrich), or 0.0080 g of $Pd(NO_3)_2xH_2O$ (99.9% metal basis, Pd 39%, Alfa Aesar) was dissolved in 30 μL of deionized water for the synthesis of Ag, Cu, and Pd NWs, respectively. Then each precursor solution was deposited over the surfaces of Whatman Anodisc 25 AAMs in 5 μL drops until the entire surfaces were covered and were left to air dry for 30 min. For the reduction a small pellet of solid sodium borohydride (~0.006 g) [$NaBH_4$ 98% mm—Alfa Aesar] was spread evenly on the side opposite to the impregnation of each membrane.

In each case the membranes changed immediately to a dark color indicating that the metal had been reduced. To remove the $NaBH_4$ the samples were dipped three times for 30 min in a large bath of cold water. Subsequently, the samples were placed into a 20 M sodium hydroxide (NaOH) solution and were agitated for 1 day to dissolve the membrane. The NWs were then cleaned in ionized water. Traces of alumina membrane were observed in the SEM images of samples when lower concentrations of NaOH were used to dissolve it. Ag NWs were also prepared using metal loadings of 1 wt. % and 2.5 wt. %.

The morphology of the nanowires was examined via scanning electron microscopy (SEM) using a JEOL-JSM-5410 LV, employing an accelerating voltage of 30 kV.

Metal Nanowires Synthesized Via Solid-State Reduction Method

The structure of Pd, Cu, and Ag NWs synthesized by means of SSR method was examined using XRD (not shown). All the samples had the XRD pattern corresponding to their fcc bulk counterpart.

Figure 1:
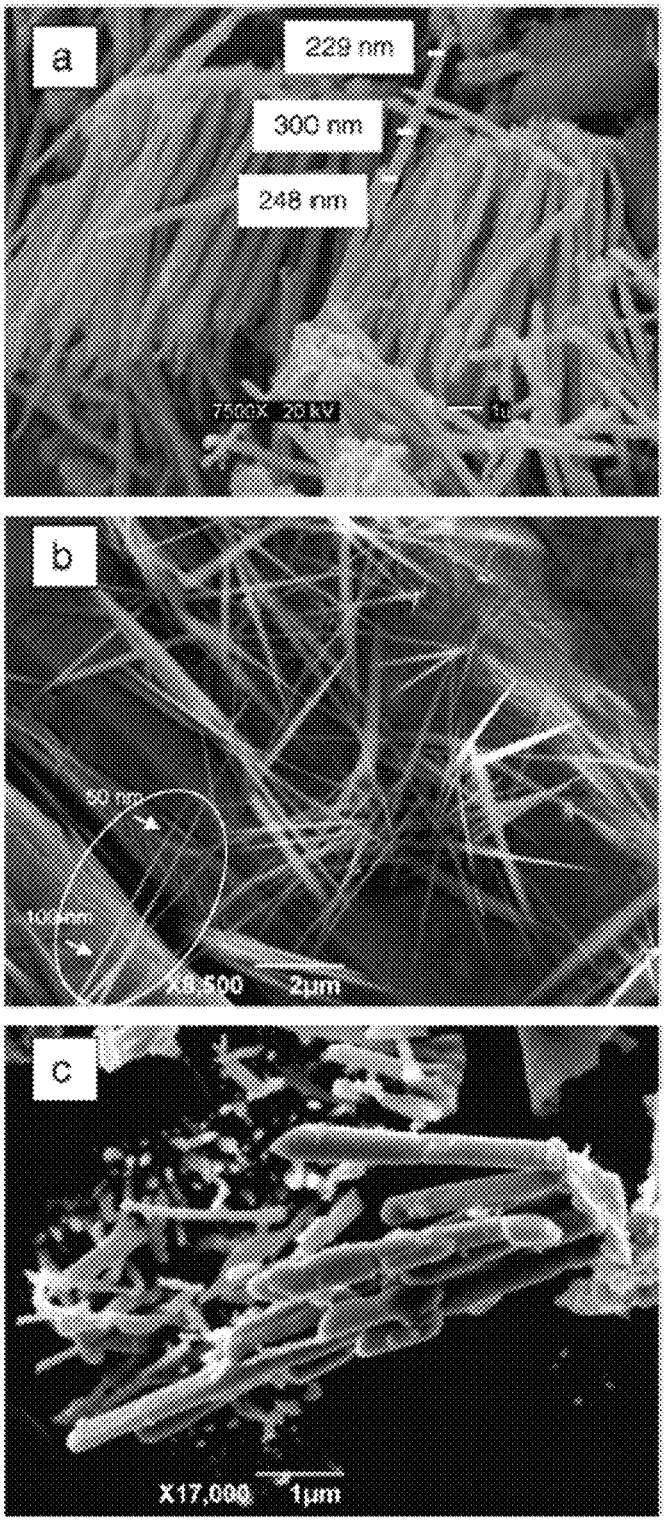
FIG. 1 shows SEM images of Ag, Cu, and Pd nanowires synthesized according to the method of the present invention.

FIG. 1*a-c* shows the SEM images of the Pd, Cu, and Ag NWs synthesized by SSR with 5% metal loading after dissolution of the AAM template, respectively. All the MNWs showed a tapering in their diameter. The diameters of Pd and Cu NWs ranged between 229 nm and 300 nm and from 50 to 100 nm, respectively where the largest diameter is consistently around the middle. Both showed a uniform wire length of 5 μm indicating that the nanowires grew at the same rate in each pore during the reduction. The fact that the diameter of the Pd NWs was larger than the 200 nm average pore size of the AAM suggests that the reduction rate of the Pd precursor was very high and expanded the pore of the membrane.

On the other hand, the diameter and length of the Ag NWs ranged between 140 and 300 nm and 1.6 and 3.5 μm, respectively. This suggests that the NWs did not grow at the same rate as the Pd and Cu NWs did. Also more defects are present in these NWs suggesting that the Ag precursor had a stronger interaction with the alumina membrane.

As previously suggested, the reduction is presumed to occur when the reaction of NaBH4 with ambient water occurs liberating electrons that create a negatively charged field on that side of the membrane which works as a driving force for the positively charged precursor to diffuse through the membrane, producing the nanowires when in contact with the electrons.

Figure 2:
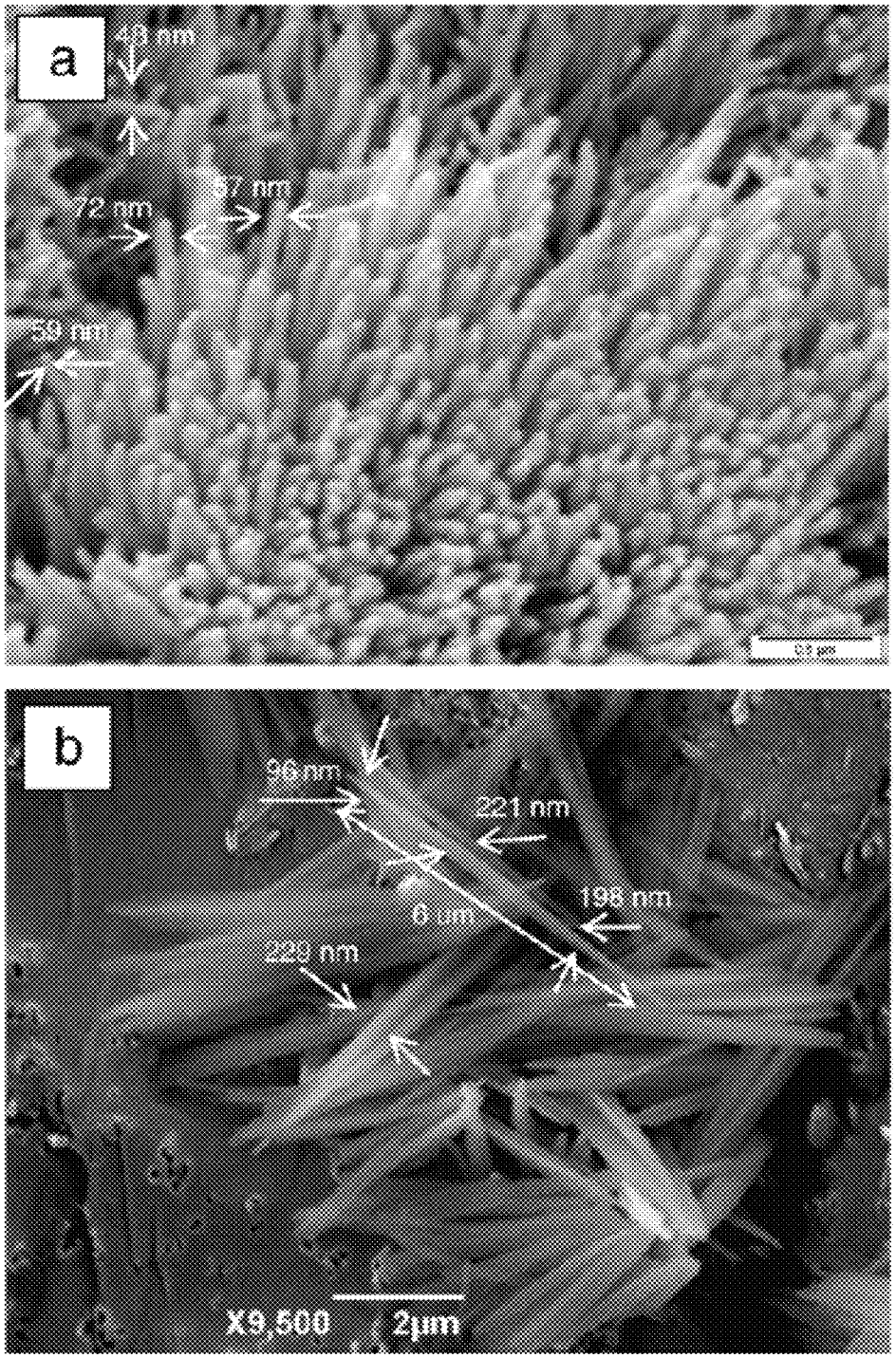
FIG. 2 shows SEM images of Ag nanowires synthesized according to the method of the present invention.

As stated above, the effect of metal loading was studied for Ag. The Ag NWs synthesized using 1 wt. % metal loading had a diameter between 48 and 72 nm and the 2.5 wt. % sample had a tapered diameter of 96 to 229 nm (FIG. 2). These diameters are smaller in the 5 wt. % sample. These results show that the metal loading concentration influences the diameter of the nanowires and thus can be controlled with the SSR method. Also, these nanowires had less defects suggesting that they interacted less with the AAM.

On the other hand, the Pd MNWs obtained by SSR were compared with those obtained by electrodeposition using a modification of the electrodeposition technique reported by Inguanta et al. and Bentley et al. Pd NWs were synthesized on AAM using a 1.5 V DC source, Ni and Cu electrodes and an electrolyte solution containing 100 mL of 0.1 M boric acid ($H_3Bo_3$, Sigma Aldrich) and 7 mM tetraammine-palladium (II)-nitrate ($Pd(NH_3)_4(NO_3)_2$, 10 wt. % solution in H2O, Sigma Aldrich). The morphology of the Pd NWs was examined with SEM (not shown). It was found that the nanowire length increases with deposition time. The Pd NWs grew to about 5 μm after six days of deposition and after ten days of deposition were approximately 7 μm long. This technique allowed straight, dense and continuous nanowire arrays with a uniform diameter of 200 nm throughout their entire length.

These results of varying length with time are consistent with the results obtained by Carreon-Gonzalez et al. for the synthesis of Ag NWs via electrodeposition and Inguanta et al. for Cu and Pd NWs via electroless deposition although the timescales are different.

Comparison of the Pd results with the two methods shows that with electrodeposition the diameter of the nanowires is homogeneous while with SSR it is tapered, however the width of the NWs with SSR can be controlled with concentration while with the electrodeposition setup used only the length of the NWs could be controlled. The timescales for the formation of the nanowires are also very different; days in the case of electrodeposition and less of an hour total for the SSR. Finally the biggest difference among the methods is that the SSR does not need any special equipment, only the materials used for the synthesis and standard laboratory equipment, and can be applied to multiple metal precursors without the need of changing the experimental setup.

It is important to mention that this technique has the potential to be applicable to other membranes having uniform pores, other organic metal precursors and other solid reducing agents with high reducing potential such as lithium borohydride, and potassium borohydride and that an invention disclosure form has been submitted.

A successful novel method to fabricate metal nanowire arrays inside of the pores of anodic alumina membranes was presented. The metal loading was shown to have an important effect on the width of the NWs, even growing wider than the initial pore width of the membrane in some cases. In comparison with the electrodeposition, this technique enables a faster growth of nanowires, requires less equipment, and is easier to adapt to the synthesis of different MNWs.

Although the present invention has been described herein with reference to the foregoing exemplary embodiment, this embodiment does not serve to limit the scope of the present invention. Accordingly, those skilled in the art to which the present invention pertains will appreciate that various modifications are possible, without departing from the technical spirit of the present invention.

We claim:

1. A method for synthesizing metal nanowires in anodic alumina membranes using solid state reduction comprising:

depositing dropwise a solution of a metal precursor over a surface of an anodic alumina membrane to form a deposited surface;

drying said deposited surface;

reducing said metal precursor by spreading $NaBH_4$ on a surface of said anodic alumina membrane opposite to the surface previously deposited with said solution of a metal precursor;

removing said $NaBH_4$ by immersing said membrane in water; and dissolving the membrane by placing said membrane in a solution of sodium hydroxide.

2. The method of claim 1, wherein said precursor solution is prepared by dissolving one of: $AgNO_3$, $Cu(NO_3)_2.2.5H_2O$ or $Pd(NO_3)_2xH_2O$ in deionized water.

3. The method of claim 1, wherein said $NaBH_4$ comprises a small pellet of solid $NaBH_4$.

4. The method of claim 1, wherein said solution of a metal precursor is deposited dropwise until the entire surface of said anodic alumina membrane is covered.

5. The method of claim 1, wherein said drying comprises drying with air.

6. The method of claim 1, wherein said $NaBH_4$ is spread evenly on said opposite surface.

7. The method of claim 1, wherein said water is cold water.

8. The method of claim 1, further comprising agitating the membrane placed in said solution of sodium hydroxide.

9. The method of claim 1, further comprising cleaning a resultant nanomaterial in ionized water after said membrane is dissolved.

10. The method of claim 1, wherein said solution of a metal precursor is deposited over said surface of said anodic alumina membrane using incipient wetness impregnation.

* * * * *